United States Patent [19]

Arbter

[11] Patent Number: 4,615,432

[45] Date of Patent: Oct. 7, 1986

[54] COILED FLEXIBLE WORKPIECE TRANSPORTING DEVICE

[75] Inventor: Conrad Arbter, Saal an der Saale, Fed. Rep. of Germany

[73] Assignee: Kolb & Schüle, Fed. Rep. of Germany

[21] Appl. No.: 672,348

[22] Filed: Nov. 16, 1984

[30] Foreign Application Priority Data

Nov. 19, 1983 [DE] Fed. Rep. of Germany ..... 3341892

[51] Int. Cl.[4] ..... B65G 35/02

[52] U.S. Cl. ..... 198/725; 198/735; 198/836

[58] Field of Search ..... 198/725, 735, 644, 860.3, 198/836; 226/88, 113; 493/248, 416, 439; 198/582

[56] References Cited

U.S. PATENT DOCUMENTS 3,129,823 4/1964 Bilocq ..... 198/457

FOREIGN PATENT DOCUMENTS 1215099 4/1966 Fed. Rep. of Germany ..... 226/113
2604007 8/1977 Fed. Rep. of Germany ..... 198/735
911459 11/1962 United Kingdom ..... 198/406

*Primary Examiner*—Joseph E. Valenza
*Assistant Examiner*—Kyle E. Shane
*Attorney, Agent, or Firm*—McGlew and Tuttle

[57] ABSTRACT

In a device for the transport of workpieces of flexible materials which are to be supplied to a treatment station in a coil for treating their longitudinal edges and the workpiece in the form of a coil from which a portion to be treated projects is sent, or positioned on, a transport device which includes a transport trough which receives the coil. The trough is provided on one or both long sides with a supporting bending edge and a bearing surface arranged vertically below it. A coiled workpiece may be transported by the device at high speed and moved to align its longitudinal edge or edges to be treated at various work stations without difficulty.

11 Claims, 5 Drawing Figures

COILED FLEXIBLE WORKPIECE TRANSPORTING DEVICE

FIELD AND BACKGROUND OF THE INVENTION

This invention relates in general to article moving devices and in particular to a new and useful device for transporting a coiled flexible workpiece which includes means for supporting a projecting edge thereof for presenting it at various work stations.

The invention relates to a device for transport of workpieces of flexible materials, such as linens or the like, which are to be fed to a treatment station for treating their longitudinal edges.

Until now, workpieces of flexible materials are brought to the respective treatment stations either lying flat, with the use of conveyor belts, or suspended from straps. Apart from the fact that large-area workpieces require much space for transport and processing, the necessary transport means are extremely expensive and trouble-prone and often permit only inexact feeding due to the material shifting on the conveyor belts, so that additional aligning is usually inevitable. Also, these transport means are unsuitable for conveying large area workpieces over relatively long distances. But mainly it is a disadvantage that the transport speeds must be kept low and that changes of direction can be made only at great expense, if at all.

SUMMARY OF THE INVENTION

The invention provides a device for the transport of workpieces of flexible materials whereby such workpieces can be supplied to a treatment station in a very simple manner and without requiring much space. The workpieces can be transported at a high transport speed and the longitudinal edges to be treated are always directed onto the respective treatment means very exactly, so that additional time consuming aligning work is avoided. Also it is possible to manufacture the transport device economically and to install it easily, making it possible to transport workpieces of flexible material over long distances and to bring about changes of direction without difficulty.

According to the invention, the workpiece is sent, in the form of a coil from which a portion to be treated stands out, to the transport device. The transport device includes a transport trough which receives the coil and which is provided on one or both long sides with a deflecting edge supporting the projecting portion of the coil and with a bearing surface disposed vertically under the edge, for the longitudinal edge of the coil to be treated.

For a coil with two projecting portions it is very expedient to arrange, on the long side associated with the portion guided from the top outwardly, the deflecting edge laterally spaced from the transport trough, in which case the deflecting edge should be connected with the transport trough by way of a prismatic intermediate piece, and a vertically feedable aligning means should be arranged preferably centered relative to the prismatic intermediate piece.

Further, it is desirable to provide, between a deflecting edge and the bearing surface associated with it, a supporting surface extending obliquely thereto, so that the part projecting from the coil can partially rest on this supporting surface.

The transport trough may have a prismatic cross section with bearing surfaces arranged at an angle of preferably 90° to each other, or alternatively, it is possible to provide it with a circularly curved inner shell surface, to achieve a good support of the coil.

It is further appropriate to arrange the deflecting edges approximately at the level of the center of the coil to be transported. Thus the portions projecting therefrom can easily be guided over said edges while the coil is sufficiently retained.

In addition, it is advantageous to provide the bearing surfaces with aligning strips guiding the longitudinal edges of the coil, arranged preferably adjustable relative to the coil. This makes possible, in particular also at high transport speeds, an exact position correlation of the longitudinal edges.

For transport of the coil in a simple design the transport trough may be provided with transport means in the form of conveyor belts, or the like, guided e.g. over drivable rollers preferably supporting the coil under an angle of 90°. Naturally, it is possible also to displace the coils in the transport trough in some other manner.

To permit rapid removal, the transport means of the transport trough may further be followed, outside the treatment station, by a conveyor section, e.g. in the form of a conveyor belt, or the like, arranged in the center of the transport trough and supporting the coil, preferably drivable at high speed.

To preclude direct contact of the coils to be transported on each other and hence possible tilting, a spacer in the form of a ball, disc or the like may be arranged between the coil and the transport device are guided in the transport trough.

According to a variant, to transfer coil to a treatment station arranged vertically over or under a feed trough, it is provided to make a part of the transport device receiving at least one coil adjustable in height and connectable to following transport troughs.

The device for transport of workpieces of flexible materials designed according to the invention is not only very simple in structural design and hence can be manufactured and installed in an economical manner, but mainly it makes possible a transport of the workpieces at high speeds without risking a warping or distortion of the longitudinal edge to be treated. For if the workpiece is sent to the transport device as a coil, and if the device comprises a transport trough which is provided with bending edges supporting the projecting portions of the workpiece and with bearing surfaces for the longitudinal edges to be treated, the projecting portion rests only on the longitudinal edge and on the bearing surface, whereas between them it sags. During transport in lengthwise direction of the coil, therefore, only a slight friction must be overcome by the projecting portion. And as the projecting portion is stiffened in axial directions by the sagging zone thereof, warping or distortion during transport is virtually ruled out and hence a track correct transport is ensured.

As the workpiece to be treated are transported as coils and therefore in a compact form, the space required is extremely little and the transport device designed according to the invention can be accommodated and installed virtually everywhere without difficulties. And since it is readily possible, e.g. by turning or by a height displacement of parts of the transport trough, to change the transport direction of the coils or to feed them to treatment stations arranged in different planes, a very versatile usability results.

Accordingly, it is an object of the invention to provide an improved device for transporting a coil flexible workpiece such as a coiled cloth material of linen which has at least one projecting edge and which comprises a transport member which has a trough portion which receives the coiled workpiece and at least one workpiece projecting edge engaging side portion which extends alongside the length of the trough with a deflecting edge engaging the workpiece and with a workpiece projecting edge support surface disposed below the deflecting edge for supporting the projecting portion of the workpiece.

A further object of the invention is to provide a device for transporting a coil flexible workpiece which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
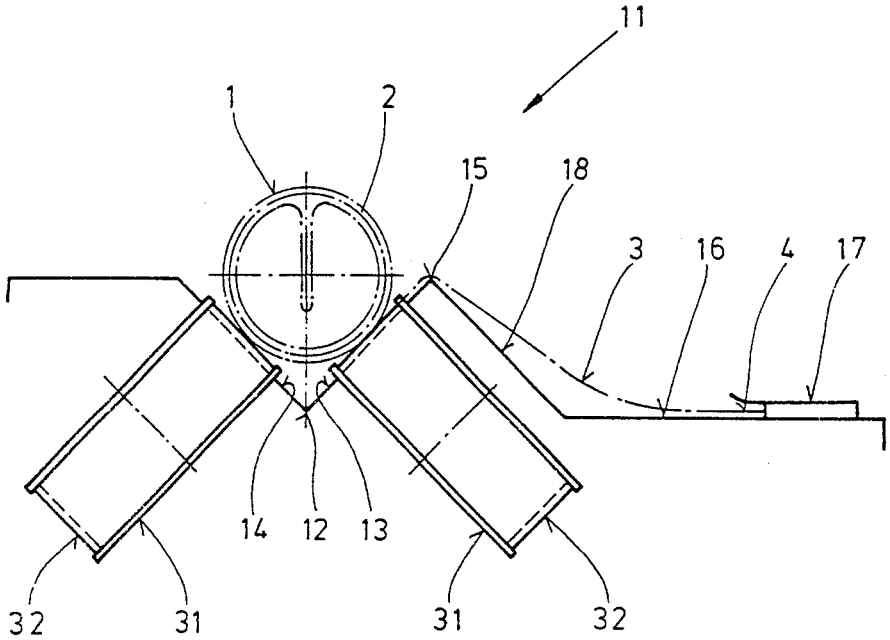
FIG. 1 is a front elevational view of a transport device comprising a transport trough with a deflecting edge and a bearing surface.

Referring to the drawings in particular the invention embodied therein comprises a device generally designated 11 for transporting a coiled flexible workpiece such as a coiled cloth material workpiece 1 which has a coiled part 2 and at least one projecting portion 3 extending from the coil. The transport device 11 has a trough portion 12 which receives the coiled workpiece 1 and has at least one workpiece projecting edge engaging side portion alongside the length of the trough portion 12 and which includes a deflecting edge 15 which engages the workpiece projecting portion and a bearing support surface 16 which is located below the deflecting edge 15 and supports part of the projecting portion of the workpiece 1. The trough 12 extends in the feed direction for coil 2 which is parallel to the axis of coil 2.

Figure 2:
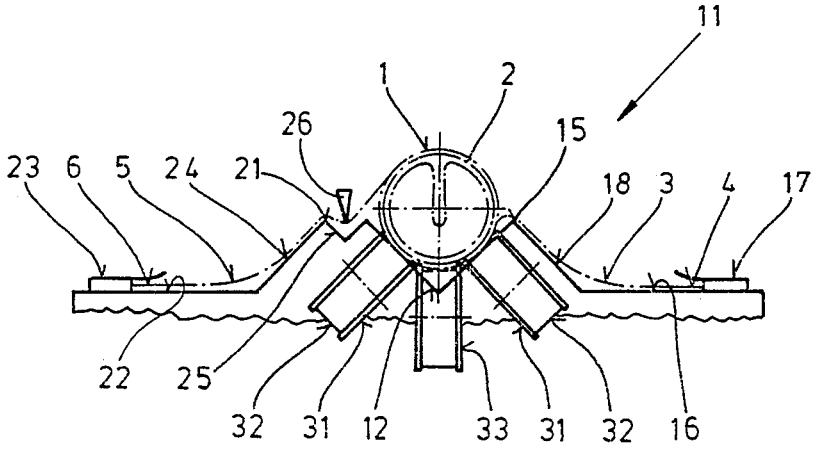
FIG. 2 is a view similar to FIG. 1 on a smaller scale with deflecting edges and bearing surfaces arranged on either side of the transport trough.
Figure 3:
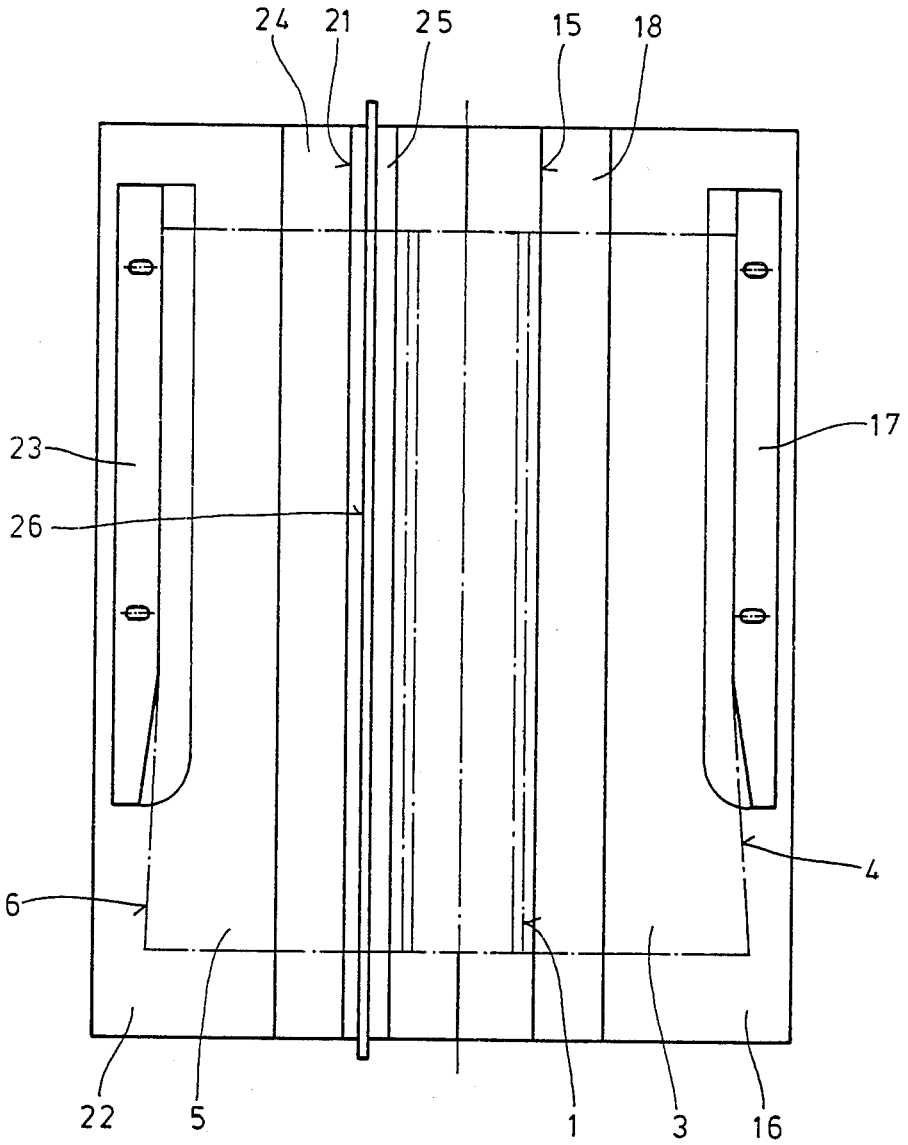
FIG. 3 is a plan view of the transport device according to FIG. 2.

The transport device illustrated in FIGS. 1 and 2 and marked 11 serves to transport flexible workpieces 1, such as linens, plastic foils or the like, which are to be treated along their longitudinal edges, and it includes transport trough 12 with bearing surfaces 13 and 14 inclined toward each other, on which the workpiece 1 supplied as a coil 2 is supported, and deflecting edges 15 and 21 as well as bearing surfaces 16 and 22 for the portions 3 and 5 projecting from the coil 2. The design according to FIG. 1 is intended for a workpiece 1 with only one projecting portion 3. By the development according to FIG. 2, also coils 2 with projecting portions 3 and 5, whose longitudinal edges 4 and 6 are to be treated simultaneously, can be transported. It is noted that, as shown in FIG. 3, the longitudinal edges 4 and 6 are about parallel to the axis of coil 2.

Between the deflecting edges 15 and 21 and the bearing surfaces 16 and 22, inclined supporting surfaces 18 and 24 are provided. In addition, the bearing surfaces 16 and 22 are equipped with respective aligning means or strips 17 and 23 which are adjustable toward and away from the coil 2, so that it is easy to make an adaptation to the length of the portions 3 and 5. In order also to ensure good contact of the portion 5 to be supplied from the top of the coil, the deflecting edge 21 is connected via a prismatic intermediate piece 25 with the transport trough 12, leaving a lateral spacing. An aligning member 26 which is adjustable in height is arranged above the piece 25 by which the portion 5 can be provided with a further arch or bend to increase its stiffness. It is here noted that edges 15 and 21, piece 25, member 26 and trough 12 all extend parallel to the axis of coil 2.

Figure 4:
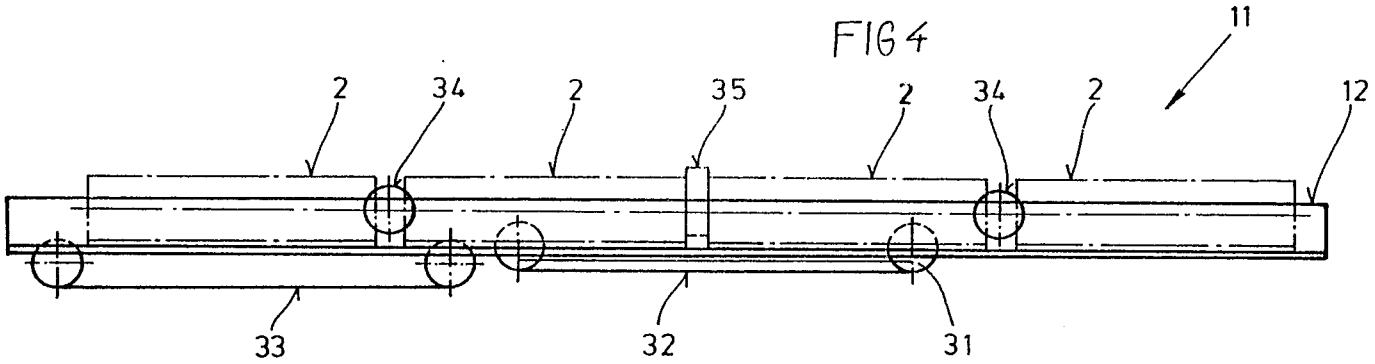
FIG. 4 is a side elevational view of the transport device according to to FIG. 2.

To transport the coils 2 introduced in the transport trough 12, transport means are used which are inclined toward each other and are in the form of conveyor belts 32 guided over driven rollers 31 and supporting the coils 2 under an angle of 90°. In addition, as can be seen from FIG. 4, for the removal of the individual coils 2 which are separated from each other by balls 34 or discs 35, they are followed by an additional conveyor belt 33, which appropriately revolves at a higher transport speed.

As the portions 3 and 5 projecting from coil 2 make contact only on the deflecting edges 15, 21 and by their ends on the bearing surfaces 16,22, and therefore they sag downwardly, a high stiffness prevails. Not only does this make it possible to transport the coils 2 at high speed, but it is virtually precluded that the longitudinal edges 4 and 6 of the projecting portions 3 and 5 become warped or distorted. Therefore, the treatment of the longitudinal edges in processing stations can be achieved without a problem without requiring additional aligning means.

Figure 5:
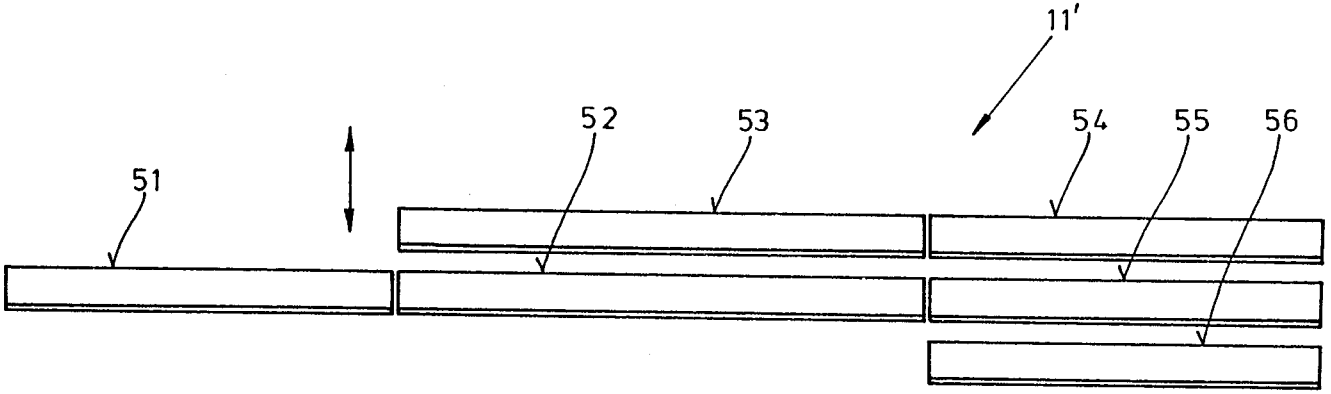
FIG. 5 is a side elevational view of a transport device according to FIG. 1 provided with portions adjustable in height, in side view.

By means of the transport device 11' shown in FIG. 5 it is further possible to transfer the coils to be transported also into different planes. Here a feed trough 51 has assigned to it two distributor troughs 52 and 53 which are designed adjustable in height relative to following transport troughs 54, 55 and 56 and connectable to the latter. By means of the distributor trough 53 connected to feed trough 54, and by means of the distributor trough 52, by lowering, into transport trough 56.

While specific embodiments of the invention have been shown and described in detail to illustrate the application of the principles of the invention, it will be understood that the invention may be embodied otherwise without departing from such principles.

What is claimed is:

1. A device for transporting a flexible workpiece in a feed direction, the flexible workpiece having a coiled portion with a coil axis extending in the feed direction and a projecting portion extending laterally away from the axis, the projecting portion having a longitudinal edge extending about parallel to the axis, the device comprising a transport member having a trough portion extending in the feed direction for receiving the coiled portion of the workpiece therein, said transport member having at least one side portion alongside said trough portion for receiving said projecting portion of said workpiece thereon, said side portion having an upper deflecting edge extending parallel to the feed direction and at a lateral side of said trough portion so that the projecting portion of the workpiece is bent on said deflecting edge, said side portion including a support surface spaced laterally away from said deflecting edge on a side of said deflecting edge away from said trough portion, said support surface being positioned below said deflecting edge for receiving at least a part of the projecting portion of a workpiece so that the projecting part forms an arc between said deflecting edge and the part of said support surface engaging the projecting portion, and aligning means mounted on said support surface and extending parallel to the feed direction for engaging and aligning the longitudinal edge of the projecting portion of the workpiece as it is moved in the feed direction with its coiled portion in said trough portion.

2. A device according to claim 1, wherein the workpiece includes a second projecting portion projecting away from the axis of the coil in an opposite direction from the first-mentioned projecting portion, the second projecting portion having a longitudinal edge extending about parallel to the axis, said transport member having a second side portion alongside said trough portion and on an opposite side of said trough portion from said first-mentioned side portion, said second side portion having a second deflecting edge extending parallel to the feed direction and a second support surface spaced laterally from said second deflecting edge and positioned below said second deflecting edge for receiving the second projecting portion of the workpiece, and second aligning means mounted on said second support surface for aligning the longitudinal edge of the second projecting portion of the workpiece.

3. A device according to claim 1, including an intermediate prismatic piece disposed between said trough portion and said second bending edge, said prismatic piece forming a recess extending in the feed direction, and an alignment member disposed over said recess and extending in the feed direction for deflecting the second projecting portion of the workpiece into said recess, the second projecting portion of the workpiece extending from a top of the coil portion of the workpiece and the first-mentioned projecting portion of the workpiece projecting from a bottom of the coiled portion of the workpiece.

4. A device according to claim 3, wherein said transport member includes a first inclined supporting surface between said first-mentioned deflecting edge and said first-mentioned support surface, said inclined supporting surface being inclined with respect to a horizontal plane sufficiently so that an arc of the projecting portion of the workpiece between said first-mentioned deflecting edge and said first-mentioned support surface remains out of contact with said first inclined supporting surface, and a second inclined supporting surface between said second deflecting edge and said second support surface, said second inclined supporting surface being inclined with respect to a horizontal plane sufficiently so that an arc of the second projecting portion between said second deflecting edge and said second support surface remains out of contact with said second inclined supporting surface.

5. A device according to claim 1, wherein said transport member includes a first inclined supporting surface between said first-mentioned deflecting edge and said first-mentioned support surface, said inclined supporting surface being inclined with respect to a horizontal plane sufficiently so that an arc of the projecting portion of the workpiece between said first-mentioned deflecting edge and said first-mentioned support surface remains out of contact with said first inclined support surface.

6. A device according to claim 2, wherein each of said first-mentioned and second deflecting edges approximately lie in a horizontal plane containing the axis of the workpiece with the coiled portion of the workpiece engaged in said trough portion.

7. A device according to claim 1, wherein said aligning means comprises an aligning strip adjustably mounted to said support surface for lateral movement toward and away from said trough, said strip having an edge for engaging a longitudinal edge of the workpiece which extends substantially in the feed direction.

8. A device according to claim 1, including a pair of conveyor belts at sides of said trough portion and extending in the feed direction, a set of driven rollers for each conveyor belt, said driven rollers of one conveyor belt having axes which extend at an angle of approximately 90° with respect to axes of said rollers of the other conveyor belt, a treatment station spaced from said transport member, at least one further conveyor belt extending in the feed direction from under said trough portion to said treatment station, and spacer means disposed between adjacent workpieces to be fed in the feed direction by said pair of conveyor belts and said further conveyor belt.

9. A device according to claim 8, including a plurality of treatment stations disposed at separate vertical levels and a plurality of said transport members for feeding workpieces into said plurality of treatment stations, said transport members being vertically movable.

10. A device according to claim 1, wherein said transport member includes first and second intersecting obliquely extending walls defining said trough position disposed at an angle of substantially 90° to each other.

11. A device according to claim 1, wherein said trough portion has a circularly curved inner shell surface.

* * * * *